United States Patent [19]

Nilsson et al.

[11] 4,383,477

[45] May 17, 1983

[54] VENTILATOR

[75] Inventors: Gösta Nilsson, Gemla; Hans Lundin, Halmstad, both of Sweden

[73] Assignee: A B Gemla Plast, Gemla, Sweden

[21] Appl. No.: 285,094

[22] PCT Filed: Nov. 26, 1980

[86] PCT No.: PCT/SE80/00301

§ 371 Date: Jul. 16, 1981

§ 102(e) Date: Jul. 16, 1981

[87] PCT Pub. No.: WO81/01606

PCT Pub. Date: Jun. 11, 1981

[30] Foreign Application Priority Data

Nov. 26, 1979 [SE] Sweden ..... 7909764

[51] Int. Cl.[3] ..... F24F 11/00

[52] U.S. Cl. ..... 98/41 AV; 98/37; 251/140; 251/230

[58] Field of Search ..... 98/37, 41 AV, 95, 118; 251/140, 138, 230

[56] References Cited

U.S. PATENT DOCUMENTS 3,173,646 3/1965 Wilcox ..... 251/138
3,220,695 11/1965 Downey et al. ..... 251/230 X
3,780,980 12/1973 Kallel ..... 251/138

FOREIGN PATENT DOCUMENTS 103246 12/1941 Sweden ..... 98/41 AV
105175 4/1917 United Kingdom ..... 98/41 AV
523672 7/1940 United Kingdom ..... 98/41 AV

*Primary Examiner*—Albert J. Makay
*Assistant Examiner*—Harold Joyce
*Attorney, Agent, or Firm*—Oblon, Fisher, Spivak, McClelland & Maier

[57] ABSTRACT

A ventilator is provided for the supply of untreated exterior air to a room. The ventilator has a valve seat (1), a valve body (2), means for connecting the ventilator to an exterior air duct (4) and operating means (6, 7) for resetting the position of the valve body. Stationary support elements (8) carry the valve body via a coupling (9) of the kind which, on repeated operating impulses from the operating means (6, 7) alternatingly takes the valve body to an outer position and returns it to an inner position. Both these positions are so selected that the inner one corresponds to the minimum demand for ventilation of an empty room while the outer one corresponds to the demand for ventillation with projected use by persons of the room.

7 Claims, 12 Drawing Figures

VENTILATOR

DESCRIPTION

1. Technical Field

The invention relates to a ventilator which is adapted for the supply of untreated exterior air to a room, and comprises a valve seat with a valve body setable thereto, means for connecting the ventilator to an exterior air duct, means for resetting the valve body and locking means for retaining the valve body in a set position.

2. Background Art

A large number of different ventilators are known for the supply of untreated exterior air to a room, e.g. flap valves and disc valves in an outside wall, and slit valves in, or under the window structure. All have the following disadvantages to a greater or less degree. They are optionally adjustable in different opening positions and can therefore, inter alia by unsuitable setting, give rise to draughts or the opposite, i.e., insufficient ventilation. If they are permanently open, or opened too much in relation to the ventilation need, they result in considerable energy losses for heating the supplied exterior air during the cold season.

DISCLOSURE OF INVENTION

The object of the invention is to provide, for the purpose of saving energy and improving environment, a ventilator of the kind disclosed in the introduction, and which is well-suited for equipping with an air filter and sound insulation, and which is easily settable between distinct minimum and maximum positions, said positions not being disturbed on resetting or cleaning, and which furthermore is well-suited for operation automatically with low power consumption.

The intended result is obtained by the ventilator being given the characterizing features apparent from the following patent claim 1.

BRIEF DESCRIPTION OF DRAWINGS

An embodiment of the invention will now be described while referring to the appended drawings.

MODE FOR CARRYING OUT THE INVENTION

Figure 1:
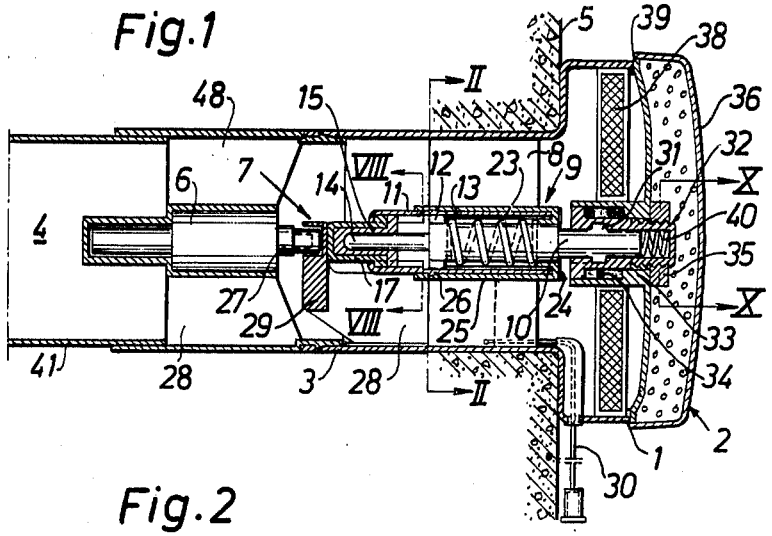
FIG. 1 is a section through the valve body and valve seat of the ventilator in the room and through its members closest to it in an exterior air duct.

The ventilator is adapted for supply of untreated exterior air to a room. The ventilator has a valve seat 1 and a valve body 2 in the form of a disc settable in relation to the valve seat. Means are arranged in the connection with the valve seat for connecting the ventilator to an exterior air duct 4 through the outer wall 5, and is illustrated in FIG. 1 solely by a pipe stub 3, which shall be assumed to be provided with conventional attaching means for installing in the outer wall 5.

In the shown embodiment, the valve has alternative operating means 6 and 7 for resetting the valve body 2 in relation to the valve seat 1.

By a coupling 9 the valve body 2 is carried by stationary support means 8, in the form of two flat carrying arms which are oriented with their greatest cross-sectional dimension in the flow direction of the air.

The coupling 9 is of the kind, which, on repeated operating impulses from either operating means 6, 7, alternately takes the valve body out to an outer position and returns it to an inner position. Both these positions are predetermined by adjustment to correspond to the maximum demand for ventilation,—for a projected use by persons of the room,—and the minimum demand for ventilation, i.e. for an empty room. In the latter case, the valve can generally be assumed to be completely closed.

Figure 3:
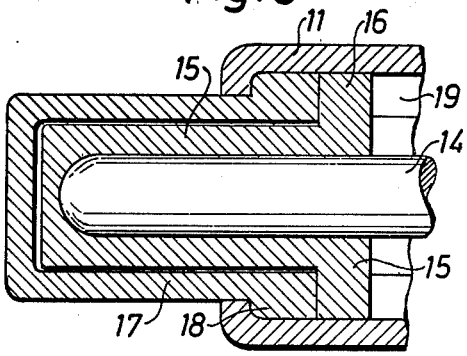
FIG. 3 is a partial section to a larger scale of an end portion of the mechanical coupling in FIG. 1.
Figure 4:
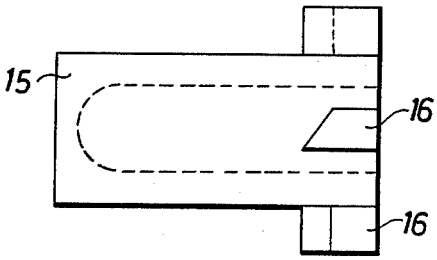
FIG. 4 illustrates to the same enlarged scale a coupling member in the mechanical coupling according to FIG. 3, seen from one side.
Figure 5:
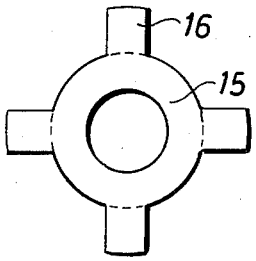
FIG. 5 is an end view to the enlarged scale of the coupling member according to FIG. 4.
Figure 6:
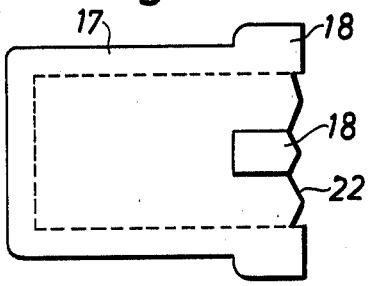
FIG. 6 is a side view in the enlarged scale of an axially displaceable mounting means for the coupling member in the mechanical coupling according to FIGS. 1–5.
Figure 7:
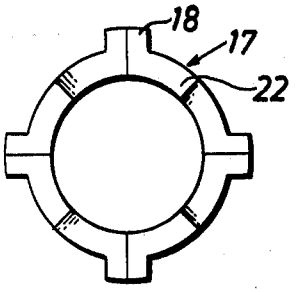
FIG. 7 is a side view to the enlarged scale of the mounting member according to FIG. 6.
Figure 8:
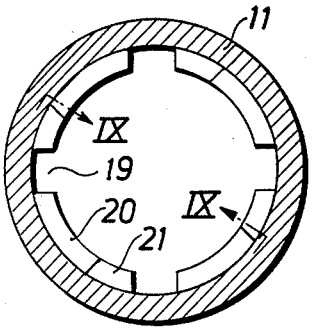
FIG. 8 is a cross section to the enlarged scale according to VIII—VIII in FIG. 1.

In other words, the coupling is of the kind known per se from ball point pens, which are adapted to give the tube of writing medium a projected and a retracted position. In its new field of use, the coupling in accordance with FIG. 1 has a spindle 10 carrying the valve body 2 at its outer end. The spindle is axially movably mounted in a hub sleeve 11 concentric with the pipe stub 3, said sleeve 11 being carried by both arms 8. The spindle is prevented from turning in the sleeve by its having two projections 12, each running in a longitudinal groove 13 in the sleeve. The inner end of the spindle has a pin 14 thrusting into an end sleeve 15, which is rotatable on the end pin and has four radially outwardly projecting teeth 16 at its end facing towards the valve body (see FIGS. 3–5). The end sleeve 15 is in turn placed in a sleeve-shaped bearing means 17, the end of which facing away from the valve body projects out from the hub sleeve 11, and the opposite end of which has four radially projecting guide lugs 18 (see FIGS. 6 and 7). The hub sleeve 11 has end stops outside these lugs preventing the bearing means 17 from falling out of the sleeve. The lugs 18 on the bearing means 17, like to the teeth 16 on the end sleeve 15, run in longitudinal grooves 19 on the inside of the hub sleeve 11, within an area of the inner end of the sleeve having greater wall thickness than the rest of the sleeve, as a result of less inner diameter. The end of the bearing means facing towards the valve body has a toothed crowns 22 with axially projecting teeth.

Figure 9:
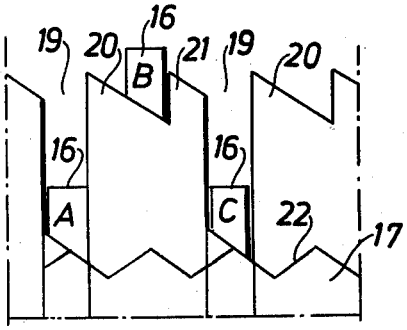
FIG. 9 is a development along IX—IX in FIG. 8, illustrating to the larger scale a crenelated profile on a coupling engagement detail co-acting with the coupling member.
Figure 10:
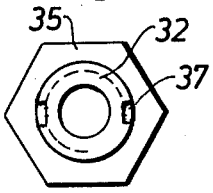
FIG. 10 is a section to the larger scale according to X—X in FIG. 1, through a device for adjusting the maximum opening of the valve body.
Figure 11:
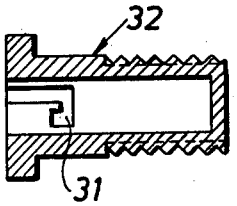
FIG. 11 is a side view to the enlarged scale of a device for releasing the valve body for cleaning.
Figure 12:
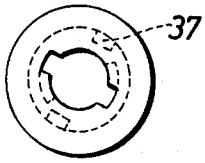
FIG. 12 is an end view of the device according to FIG. 11, and to the same scale as FIG. 11.

The material portions situated between the four grooves 19 in the hub sleeve 11 are terminated in a direction towards the valve body 2 by a crennelation having a saw-toothed profile in the circumferencial direction, as is apparent from the development in FIG. 9. The sawteeth 20 and 21 have a sloping plane conforming to the slope of the teeth 16 on the end surfaces facing away from the valve body. A tooth 16 is shown in FIG. 9 in three positions denoted A, B and C.

If the valve body 2 is in the position illustrated in FIG. 1 for a closed valve, each tooth 16 is situated in a groove 19, as indicated by position A in FIG. 9. The end sleeve 15 and the bearing means 17 do not need for that reason to have taken up their absolute end positions, but in response to the adjustment of the spindle 10 in relation to the valve body they can have a greater or less axial play in the hub sleeve 11. If either of the operating means 6, 7 gives the bearing means 17 an axial movement by sending an operating impulse, the crown 22 of the bearing means 17 urges the end sleeve 15 in the same direction. Axially, the bearing means and end sleeve engage against each other solely via the crown 22 and the sloping surfaces of the teeth 16. When the end sleeve 15, and thereby the spindle 10 and valve body 2 also, are moved outwards of the space so far that the teeth 16 have passed the ends of the grooves 19, the teeth 16, resting on the tooth tops of the crown 22, glide off the teeth of the crown and into the sloping surfaces of the sawteeth 20, as a result of a force opposing the operating impulse, this force being provided by a compression spring 23 and are taken further by the same force to the base of the sawteeth, position B in FIG. 9, when the bearing means 17 returns after the operating impulse has ceased.

From such a forward-thrust position in accordance with B in FIG. 9, in which the teeth 16 are retained by the mentioned spring force and latching action from an adjacent tooth 21, the end sleeve 15 is moved away by the subsequent operating impulse, the crown 22 of the bearing means 17 once again engaging the sloping surface of the tooth 16 (position B) and pushes the sleeve 15 so far that the tooth 16 can pass the sawtooth 21 and be taken by the sloping surface of the latter into the adjacent groove 19 and be taken by the spring force to the position C, when the bearing means 17 once again returns when the operating impulse has ceased.

Figure 2:
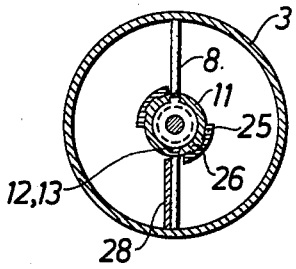
FIG. 2 is a section through a mechanical coupling according to II—II in FIG. 1.

The bearing means 17, end sleeve 15 and spindle 10 with the spring 23 are inserted into the hub sleeve 11 on assembly from the right-hand end thereof in FIG. 1, subsequent to which an end piece 24 guiding the spindle is mounted on the hub sleeve 11, the exterior tongues 25 extending along the outside of the hub sleeve. Two snap-on clips 26 retain the end piece 24 in place, as is apparent from FIG. 2 (the snap-on clips 26 are somewhat improperly indicated in FIG. 1 also).

The primary operating means 6 comprises an electromagnetic linear motor situated behind the coupling 9, which motor is supplied with current in impulses, and the working piston 27 of which executes a stroke to the right in FIG. 1 and thereby thrusts the bearing means 17 to the right so that the coupling 9 carries out a change of the valve body position, as has been described above. The piston can have a built-in (not shown) return spring or can be returned by the coupling spring 23.

The linear motor 6 is also carried by support means 48 in the form of flat carrying arms oriented with their greatest cross-sectional dimension in the flow direction of the air, and they are united by a hub-like sleeve concentric with the pipe stub 3 and surrounding the motor.

The secondary operating means 7 comprises a coupling driving dog element in the form of a blade 28 glidably arranged in guides (not shown) in a plane along one of the carrying arms 8, and is formed with a boss 29, extending in between the head of the piston 27 and the back end of the bearing means 17 in the coupling 9. The coupling driving dog element 28 is movable to the right by means of a cord, chain 30 or similar, for manually changing the position of the valve body 2 by actuating the bearing means 17.

For impulse current supply to the electromagnet of the linear motor 6, a time relay is suitably disposed for closing a supply circuit at regular intervals. The same time relay is thereby preferably adapted for serving several ventilators of the kind described, e.g. all the air ventilators in a house or living apartment. Each linear motor 6 is thereby adapted swichable between several optional changing cycles for the operating impulse, e.g. three cycles, one for setting the ventilator open during the day (for a room with general activity and the like), one for setting the ventilator open at night (for bedrooms) and one which sets the valve open during the eventing (for hoppy rooms and the like).

Suitable switching means can be placed more or less easily available, depending on what flexibility of the system is desirable or advisable.

The current supply circuit is suitably arranged for low voltage.

For setting the maximum opening position of the valve body 2 the spindle 10 is provided at its outer end with an externally threaded attachment sleeve 32 for the valve body (see FIGS. 1 and 10–12) with the aid of a bayonette-type coupling 31. A sliding sleeve 33 is slidably mounted on the attachment sleeve 32 and is made integral with the back portion of the valve body. A pressure spring 34 is biased to move the sliding sleeve outwards from the attachment sleeve. A nut 35 is threaded on to the attachment sleeve outside the back portion of the valve body, to prevent movement of the valve body outwards from the attachment sleeve. The nut 35 is accessible for adjustment of the maximum opening after removing the front portion 36 of the valve body together with a sound and heat insulating piece of porous material placed between the front portion and the back portion. The attachment sleeve 32 is provided with grooves 37 to prevent movement of the sleeve 33 on the sleeve 32, the grooves co-acting with projections (not shown) on the sleeve 33.

For rapid release of the valve body 2 without risk of altering the setting, the valve body is pressed inwards, when it is in its open position, and is truned for releasing the bayonette coupling 31, whereafter it can be pulled free from the fastening sleeve 32. An annular air filter 38 is thus also exposed, this filter surrounding the sliding sleeve 33 and by means of snap-on projections 39 is attached to the expanded forward end of the pipe stub 3. In reassembled condition, the bayonette coupling is kept in place by a compression spring 40 between the end of the spindle 10 and the bottom of the attachment sleeve 32.

The illustrated and described ventilator is suitably connected, for the passage of the exterior air through the outer wall 5, to a pipe stub 41 (FIG. 1), thrusting into a combined weather and noise protector (not shown) on the outside of the outer wall. The air filter 38 and the insulation material in the valve body 2 provide a very effective insulation against noise, cold and condensation.

Apart from the embodiment shown, the ventilator can be used with operation solely by the electromagnetic linear motor or solely by the manual operating means. Even in the latter embodiment, it is very advantageous due to its easy operation and the distinct setting positions afforded, not least in installations adapted for the handicapped.

What is claimed as new and desired to be secured by Letters Patent of the United States is:

1. A ventilator for the supply of outside air to a room, comprising:

a valve seat fixed relative to said ventilator;

a valve body movable relative to said seat in an axial direction between an open position and a closed position;

means connecting said ventilator to an air duct for supplying air to an opening defined by said valve body and valve seat when said valve body is in said open position;

operating means for moving said valve body between said open and closed positions; and latching means for maintaining said valve body in said open and closed positions, said latching means further comprising:

(a) a tubular sleeve fixed relative to said valve seat and extending in said axial direction, (b) at least two axial grooves in said tubular sleeve, the circumferential portions between said grooves at a first end of said tubular sleeve being formed as a pair of circumferentially spaced slant surfaces sloped in the same direction and connected by an axial surface, said first end of said sleeve facing said valve body, (c) bearing means positioned in said sleeve, said bearing means including guide lugs in each of said grooves for guiding said bearing means along an axial path in said sleeve, said bearing means having a first end engageable with said operating means for moving said bearing means along said path in a first directional sense, said bearing means having a second end facing said valve body, said second end having a circumferential array of alternately oppositely sloped slant surfaces forming alternate peaks and troughs, one of said peaks being circumferentially positioned at each said guide lug, whereby one said peak is movable in each said groove, (d) an end sleeve positioned in said tubular sleeve and fixed to said valve body, said end sleeve including teeth positionable in each of said grooves between said guide lugs and said first end of said tubular sleeve, each of said teeth having a first end opposite said valve body, said first end including a circumferentially slanted surface sloped in the same direction as said slant surfaces of said first end of said tubular sleeve, and (e) means for biasing said end sleeve in a second directional sense opposite said first directional sense and away from said valve body.

2. The ventilator of claim 1 wherein said operating means comprises an electromagnetic linear motor actuated by current impulses.

3. The ventilator of claim 2 wherein said motor is positioned in said air duct.

4. The ventilator of claim 2 wherein said operating means includes a manual actuator independent of said motor.

5. The ventilator of claim 1 wherein said means for biasing comprises a single spring having one end connected to an element fixed to said valve seat and a second end connected to said end sleeve.

6. Ventilator as claimed in claim 2 including a time relay adapted for initiating said impulses on the basis of expected, regularly occurring times for alteration of the ventilation load on the room caused by the presence of persons.

7. Ventilator as claimed in claim 6 wherein said time relay is adapted for serving several ventilators of the same kind, and that the electromagnetic linear motor of each said ventilator is electrically switchable between several optional changing cycles for said operating impulses.

* * * * *